United States Patent [19]

Erhardt et al.

[11] 3,998,153

[45] Dec. 21, 1976

[54] HIGH FREQUENCY POWER INTEGRATING PRINTER

[75] Inventors: Heinrich S. Erhardt, Warminster; Mosi Chu, Hatfield, both of Pa.

[73] Assignee: Sperry Rand Corporation, New York, N.Y.

[22] Filed: Mar. 18, 1975

[21] Appl. No.: 559,572

[52] U.S. Cl. ..... 101/93.48; 101/93.29; 101/DIG. 5

[51] Int. Cl.[2] ..... B41J 9/02

[58] Field of Search ..... 101/1, 426, DIG. 5, 101/DIG. 15, 93.01, 93.29, 32, 366, 90, 25, 93.48; 346/77 E, 141, 69

[56] References Cited

UNITED STATES PATENTS

| | | | |
|---|---|---|---|
| 1,935,194 | 11/1933 | Wilsey | 101/DIG. 5 |
| 2,339,199 | 1/1944 | Smith | 101/426 X |
| 3,280,740 | 10/1966 | Balamuth et al. | 101/426 |
| 3,486,449 | 12/1969 | Levine | 101/426 |
| 3,890,892 | 6/1975 | Loose et al. | 101/32 |

*Primary Examiner*—Edward M. Coren

*Attorney, Agent, or Firm*—Griffin, Branigan, & Butler

[57] ABSTRACT

In order to reduce the noise resulting from the act of printing in a typewriter or line printer, the hammer is oscillated at high frequency with low power pulses, and the oscillating hammer is moved into proximity to the inked ribbon whereby the hammer repetitively impacts the ribbon in order to print one character.

3 Claims, 3 Drawing Figures

HIGH FREQUENCY POWER INTEGRATING PRINTER

BACKGROUND OF THE INVENTION

The present invention relates to electric typewriters, word processors, computer output printers, and similar printing devices. The present invention provides a novel printing apparatus and a novel method of operating printing apparatus whereby the noise resulting from a printing operation is materially reduced.

Conventional impact printers generally employ a single, high-power hammer stroke of short duration to transfer ink from an inking ribbon to a copy paper. The transfer is accomplished by a single impact of the hammer against the ribbon, the hammer striking the ribbon only once, but being driven at high power. Because the noise generated during the printing operation is dependent on the peak power delivered to the hammer and dissipated during impaction, these conventional impact printers tend to be undesirably noisy.

While impactless printers have been developed which eliminate the noise problem, these printers fail to attain the printing quality attained by impact printers.

SUMMARY OF THE INVENTION

An object of the present invention is to provide a novel method of, and apparatus for, impact printing.

An object of the present invention is to provide an impact printer wherein the printing is accomplished with less noise generation than in presently known printers.

An object of this invention is to provide an impact printer wherein the hammer is pulsed repeatedly at low power on each cycle, whereby the hammer repeatedly impacts an inking substrate with the minimal power required to transfer ink from the substrate to a sheet of paper.

In accordance with the principles of the invention, the above-stated and other objects of the invention are attained by the provision of an impact printer of the type including a hammer means, a character matrix, and an inking substrate, the hammer means being actuated at high frequency by low power pulses such that on each print cycle the hammer repeatedly impacts the inking substrate and a sheet of paper against the character matrix to thereby cause repeated transfers of ink from the substrate to the paper on each print cycle. The hammer means includes means for oscillating the hammer impact element at high frequency, and means for moving the oscillating impact element into proximity to the inking ribbon.

Other objects of the invention and its mode of operation will become apparent upon consideration of the following description and the accompanying drawing.

DESCRIPTION OF A PREFERRED EMBODIMENT

Figure 1:
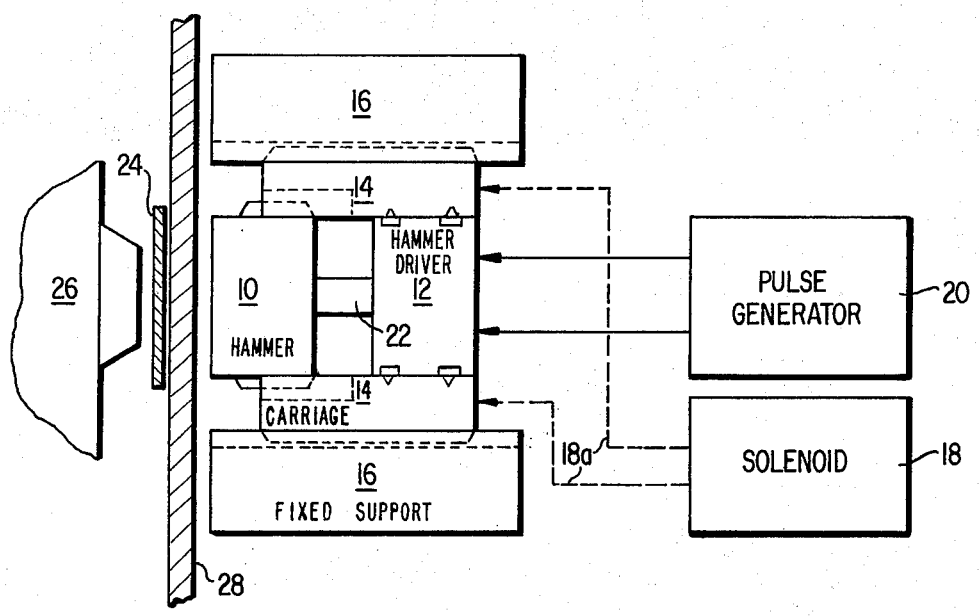
FIG. 1 is a schematic side view of an impact printer employing a vibrating hammer.

As illustrated in FIG. 1, a preferred embodiment of a power integrating printer comprises a hammer or impact element 10, an electro-mechanical hammer driver 12, and an impact element locator carriage 14. The impact element locator carriage is supported in a fixed support 16 so as to permit free movement of carriage 14 only to the left and right as viewed in FIG. 1.

The carriage 14 is driven between first and second positions relative to support 16 by any suitable means such as an electro-mechanical actuator or solenoid 18 and linkage means 18*a*. Both hammer 10 and hammer driver 12 are carried by carriage 14 and move therewith. In addition, the hammer driver 12, which is fixed relative to carriage 14, oscillates the hammer relative to the carriage. To this end hammer driver 12 is pulsed by a high frequency pulse generator 20, and is connected by a linkage means 22 to oscillate the hammer at high frequency in response to pulses from the pulse generator.

A conventional marking substrate or inking ribbon 24, and a conventional character matrix 26 (an ingraved or inscribed die or stamp) are provided adjacent the path of the print-receiving material or paper 28. As illustrated, the inking ribbon is on the side of paper 28 opposite the hammer 10.

A typical printing cycle may be as follows. Low power pulses like those of FIG. a*b* are continuously generated by pulse generator 20 and applied to the hammer driver 12. The hammer driver continuously oscillates the hammer 10 but the hammer does not impact on paper 10 because during this interval solenoid means 18 is inactive so that through linkage 18*a*, it holds carriage 14 in its first or right-most position.

When a character is to be printed, the character matrix is first positioned and then solenoid 18 is energized so as to move the carriage 14 to its left-most position. When the carriage is in the left-most position the hammer 10 impacts on paper 28 each time solenoid 12 is pulsed by pulse generator 20. Each time the hammer strikes the paper, it drives the paper and ribbon 24 against matrix 26 to transfer ink from the ribbon to the paper.

Figure 2A:
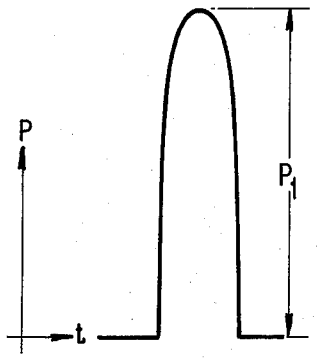
FIGS. 2*a* and 2*b* are waveform diagrams illustrating the operation and advantages of the invention.
Figure 2B:
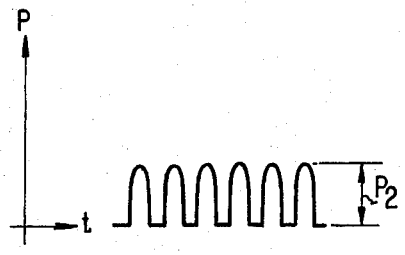

Referring to FIGS. 2A and 2B, FIG. 2*a* depicts a single hammer print impulse for a prior art printer whereas FIG. 2B depicts the hammer impulses for the present invention. For both cases the energy required to form an image is constant, hence, $$\int P_1 dt = \sum_{N=1}^{K} \int_{\Delta T} P_2 dt, \text{ where } K \text{ is}$$

the number of power pulses per print cycle. Since noise is proportional to P, and since $P_2$ is less than $P_1$, the present invention results in less noise than the prior art printers. The magnitude of each pulse $P_2$ should be at or just above the threshold level necessary to separate ink from the ribbon.

While a preferred embodiment of the invention has been described in specific detail; it will be understood by those skilled in the art that various modifications and substitutions may be made in the described embodiment without departing from the spirit and scope of the invention as defined by the appended claims.

We claim:

1. In a printer mechanism of the type having a hammer that is actuated to impact a paper and inking substrate between a print member and said hammer, the improvement comprising:

a stationary support;

a hammer carriage mounted on and supported by said stationary support and moveable between a first position and a second position on said stationary support, said hammer being mounted on said carriage and moveable relative thereto;

means linked to said carriage for moving said carriage between said first position whereat said hammer cannot impact said paper when moved relative to said carriage and said second position whereat said hammer impacts said paper and inking substrate between said hammer and said print member each time said hammer is impulsed; and, hammer impulsing means separate from said means for moving said carriage, said hammer impulsing means mounted on said carriage and being linked to said hammer for repetitively impulsing said hammer each time said carrige is at said second position.

2. A printer mechanism as claimed in claim 1 wherein the means repetitively impulsing said hammer comprises means operative on each print cycle for producing a plurality of power pulses, each said pulse being at approximately the threshold level required to separate ink from said inking substrate.

3. A printer mechanism as claimed in claim 1 wherein said print member is a moveable character matrix.

* * * * *